US006776070B1

(12) United States Patent
Mason et al.

(10) Patent No.: US 6,776,070 B1
(45) Date of Patent: Aug. 17, 2004

(54) IRON ROUGHNECK

(75) Inventors: David B. Mason, Anaheim Hills, CA (US); George Boyadjieff, Bell Park, CA (US); Johannes Henricus Antonius Marie Kamp, Etten-Leur (NL); Ronaldus Richardus Maria Roling, Rosmalen (NL)

(73) Assignee: Varco I/P, Inc, Houston, TX (US)

( * ) Notice: Subject to any disclaimer, the term of this patent is extended or adjusted under 35 U.S.C. 154(b) by 0 days.

(21) Appl. No.: 09/563,111

(22) Filed: May 2, 2000

Related U.S. Application Data

(60) Provisional application No. 60/132,141, filed on May 2, 1999.

(51) Int. Cl.[7] ..... B25B 13/50

(52) U.S. Cl. ..... 81/57.35; 81/57.4

(58) Field of Search ..... 81/57.34, 57.24, 81/57.25, 57.35, 57.4, 57.41

(56) References Cited

U.S. PATENT DOCUMENTS 2,544,639 A * 3/1951 Calhoun ..... 81/57.16
3,892,148 A 7/1975 Wiley ..... 81/57.18
4,023,449 A 5/1977 Boyadjieff ..... 81/57.16
4,178,817 A * 12/1979 Gibson ..... 81/57.13
4,221,269 A * 9/1980 Hudson ..... 81/57.21
4,348,920 A 9/1982 Boyadjieff ..... 81/57.25
5,054,550 A * 10/1991 Hodge ..... 166/78.1
5,660,087 A * 8/1997 Rae ..... 81/57.2
5,671,961 A * 9/1997 Buck ..... 294/116
5,842,390 A * 12/1998 Bouligny et al. ..... 81/57.34
6,142,041 A * 11/2000 Buck ..... 81/57.35
6,263,763 B1 * 7/2001 Feigel et al. ..... 81/57.34
6,334,376 B1 * 1/2002 Torres ..... 81/372

* cited by examiner

*Primary Examiner*—Lee D. Wilson
(74) *Attorney, Agent, or Firm*—Christie, Parker & Hale LLP

(57) ABSTRACT

An iron roughneck has a pair of upper jaws carrying pipe gripping dies for gripping tool joints. The jaws have recesses formed on each side of the pipe gripping dies to receive spinning rollers. By positioning the spinning rollers in the upper jaws at the same level as pipe gripping dies, the spinning rollers are able to engage the pipe closer to the lower jaws and thus can act on the tool joint rather than on the pipe stem.

14 Claims, 9 Drawing Sheets

IRON ROUGHNECK

CROSS-REFERENCE TO RELATED APPLICATIONS

This application is based on provisional patent application serial No. 60/132,141 filed May 2, 1999.

BACKGROUND OF THE INVENTION

In running a string of drill pipe or other pipe into or out of a well, a combination torque wrench and spinning wrench has been used for connecting and disconnecting the various drilling components, such as drill pipes and drill collars. Such combination torque wrenches and spinning wrenches are often referred to as "iron roughnecks". These devices combine torque and spinning wrenches and are described in U.S. Pat. No. 4,023,449, U.S. Pat. No. 4,348,920, and U.S. Pat. No. 4,765,401, all to Boyadjieff, and all of which are incorporated by reference in their entirety into the present disclosure.

In the prior an iron roughnecks, spinning wrenches and a torque wrenches are mounted together on a single carriage but are, nevertheless, separate machines. When "breaking-out", or loosening, connections between two joints of drill pipe, the upper jaw of the torque wrench is used to clamp onto the end portion of an upper joint of pipe, and the lower jaw of the torque wrench clamps onto the end portion of the lower joint of pipe. Drill pipe manufacturers add threaded components, called "tool joints", to each end of a, joint of drill pipe. They add the threaded tool joints because the metal wall of drill pipe is not thick enough for threads to be cut into them. The tool joints are welded over the end portions of the drill pipe and give the pipe a characteristic bulge at each end. One tool joint, having female, or inside threads, is called a "box". The tool joint on the other end has male, or outside threads, is called the "pin".

After clamping onto the tool joints, the upper and lower jaws are turned relative to each other to break the connection between the upper and lower tool joints. The upper jaw is then released while the lower jaw remains clamped onto the lower tool joint. A spinning wrench, which is separate from the torque wrench and mounted higher up on the carriage, engages the stem of the upper joint of drill pipe and spins the upper joint of drill pipe until it is disconnected from the lower joint.

Because the spinning wrench and the torque wrench are separate mechanisms, the spinning wrench cannot get close enough to the torque wrench to engage the tool joint, so the spinning wrench must engage the pipe, if at all, along its stem.

Because the spinning wrench can not get close enough to the torque wrench, the iron roughnecks of the prior art cannot be used for connecting and disconnecting some types of drill stem components. For example, spiral collars have external stabilizers along the stem which can be damaged by the rollers of a spinning wrench. Other components have other variations in surface and shape which make them unsuitable for contact with spinning rollers along their stems.

SUMMARY OF THE INVENTION

The iron roughneck of the present invention allows the automated connection and disconnection of a wide variety of drill stem components without damaging those components. The spinning wrench is integrated with the torque wrench into a single device so that the spinning rollers engage the component at the same level as the torque wrench jaws. This allows the spinning rollers to engage the tool joint rather than the pipe stem and thus avoid, for example, stabilizer blades and other features which would prevent the use of the spinning wrench of a prior iron roughneck. This integration of the spinning wrench with the torque wrench also permits the spinning and torquing of a pair of pipe joints without repositioning the torque wrench and the spinning wrench. It allows a more compact design, and provides a greater torque to drive power ratio.

Other features and advantages of the present invention will be apparent from the following detailed description when read in conjunction with the accompanying drawings.

BRIEF DESCRIPTION OF THE DRAWINGS

In the drawings, which constitute part of this specification, embodiments demonstrating various features of the invention are set forth as follows.

DETAILED DESCRIPTION OF THE PREFERRED EMBODIMENTS

Although detailed illustrative embodiments are disclosed herein, other suitable structures and machines for practicing the invention may be employed and will be apparent to persons of ordinary skill in the art. Consequently, specific structural and functional details disclosed herein are representative only; they describe the preferred embodiments of the invention.

Figure 1:
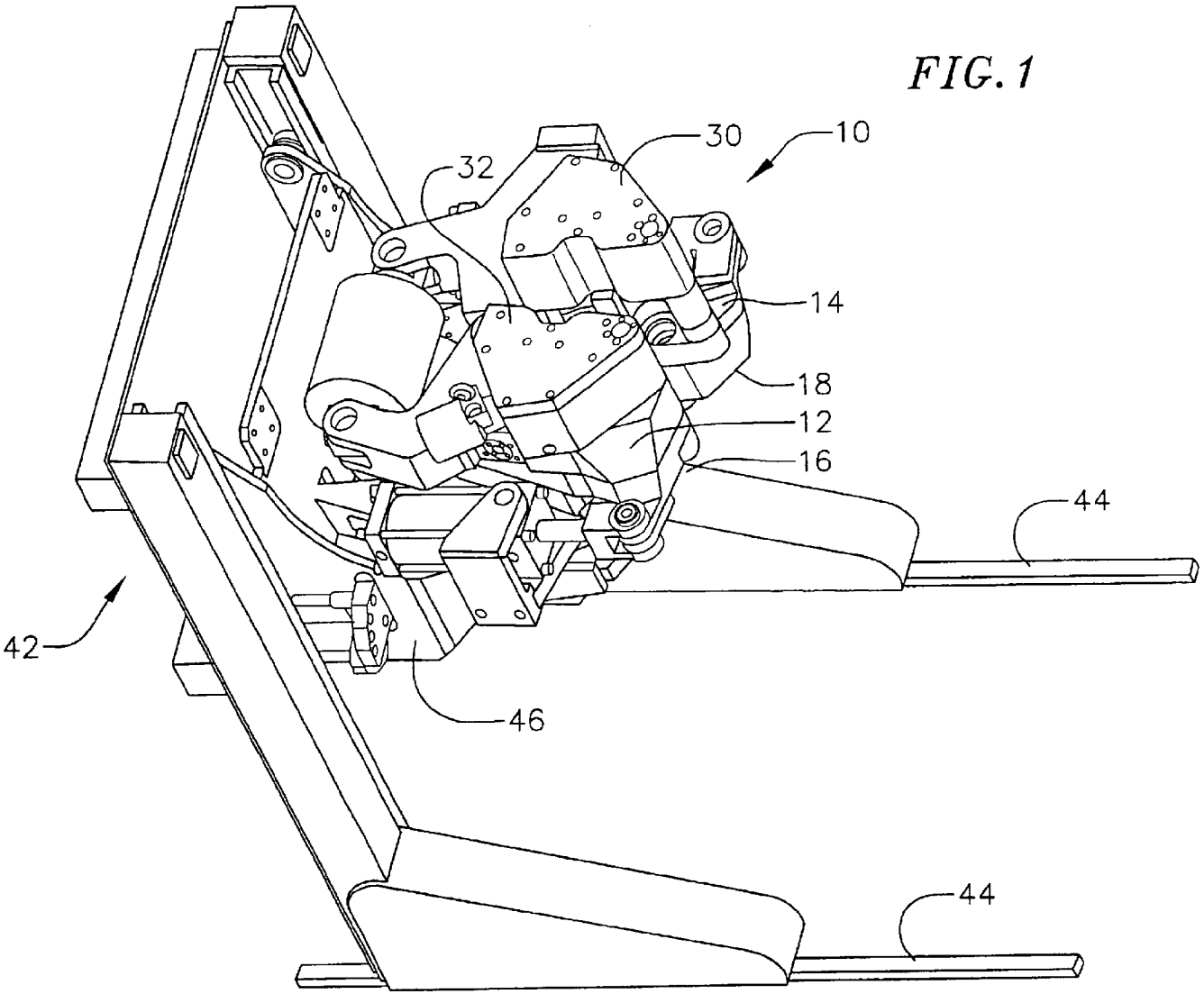
FIG. 1 is a perspective view of the iron roughneck constructed according to one embodiment of the invention, attached to a carriage.
Figure 2:
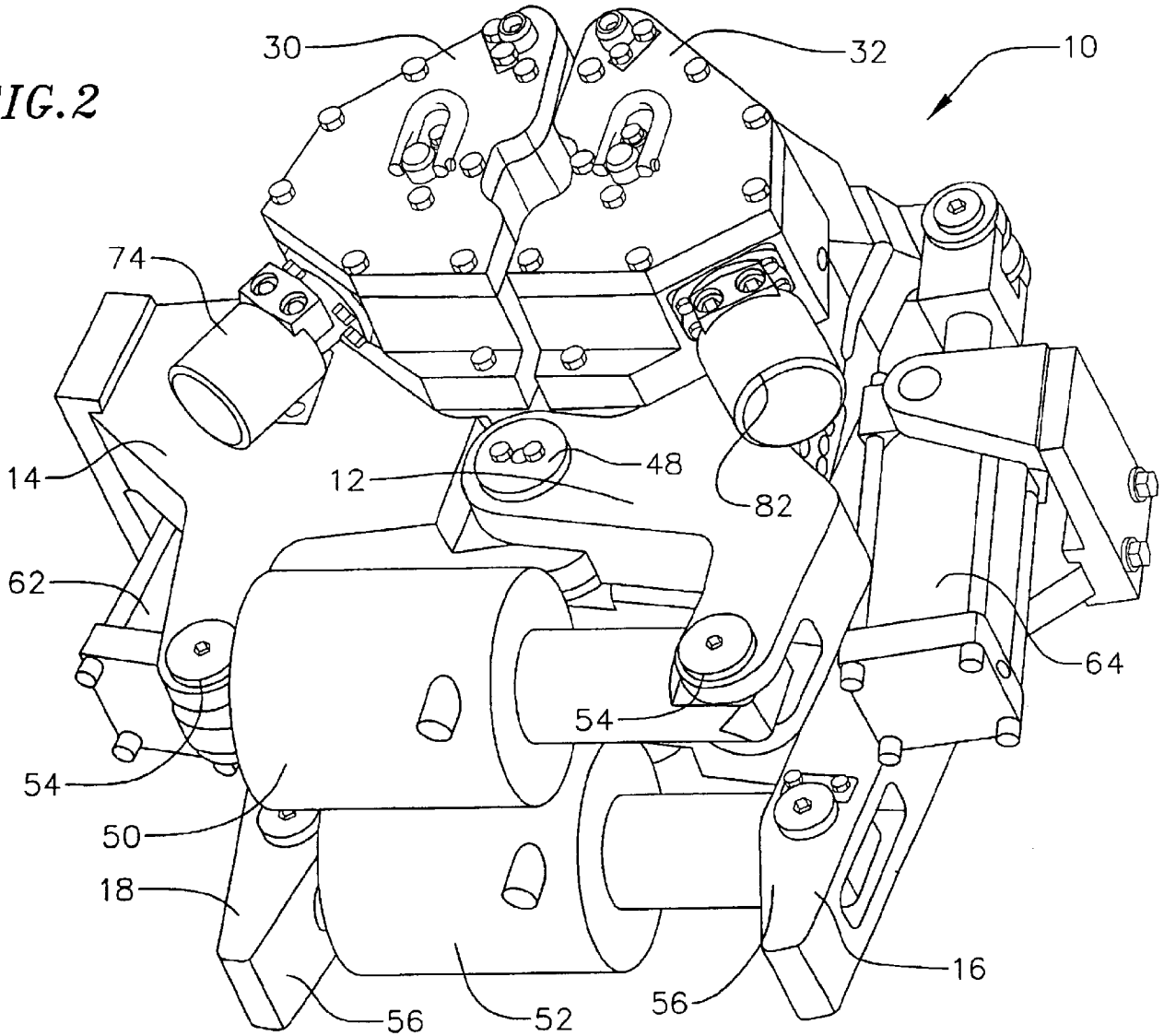
FIG. 2 is a back side perspective view of the iron roughneck of FIG. 1.

FIGS. 1 and 2 illustrate an iron roughneck 10 constructed according to one particular embodiment of the present invention. An upper right jaw 12, an upper left jaw 14, a lower right jaw 16, and a lower left jaw 18 of the iron roughneck each have one pipe gripping die element or "tong die" (FIG. 8) for gripping the tool joints of two drill pipe sections to be connected or disconnected. Although the invention is described primarily as being used to connect and disconnect tool joints of drill pipe, it can also be used to connect and disconnect many other drilling components including but not limited to blowout preventers, drill collars, drill collars with spiral grooves, stabilizers, drill bits, and bottom hole assemblies including drill bits.

Figure 5:
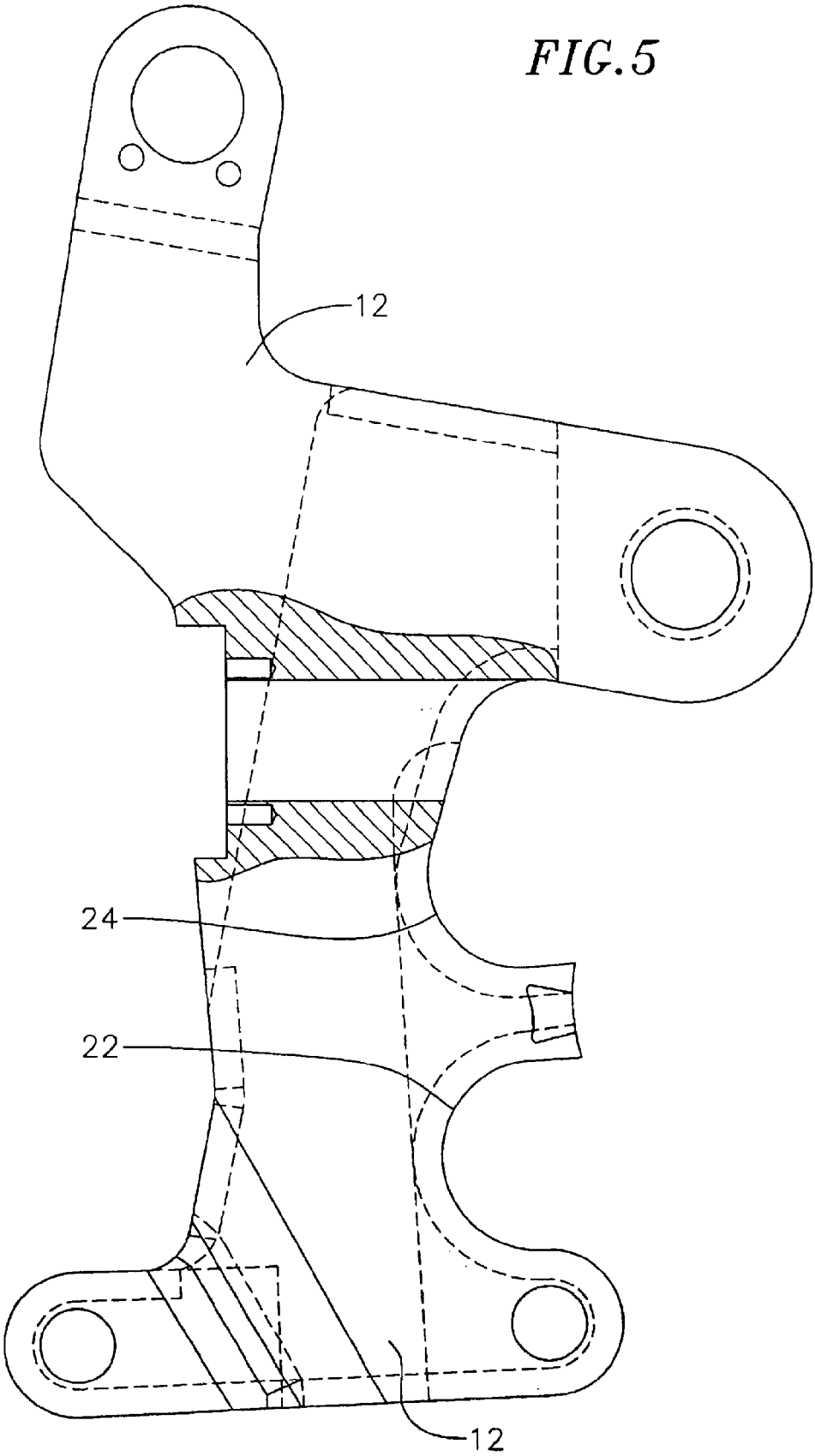
FIG. 5 is a top plan view of the right upper jaw of the iron roughneck of FIG. 1 showing recesses for inserting the two spinning rollers.
Figure 6:
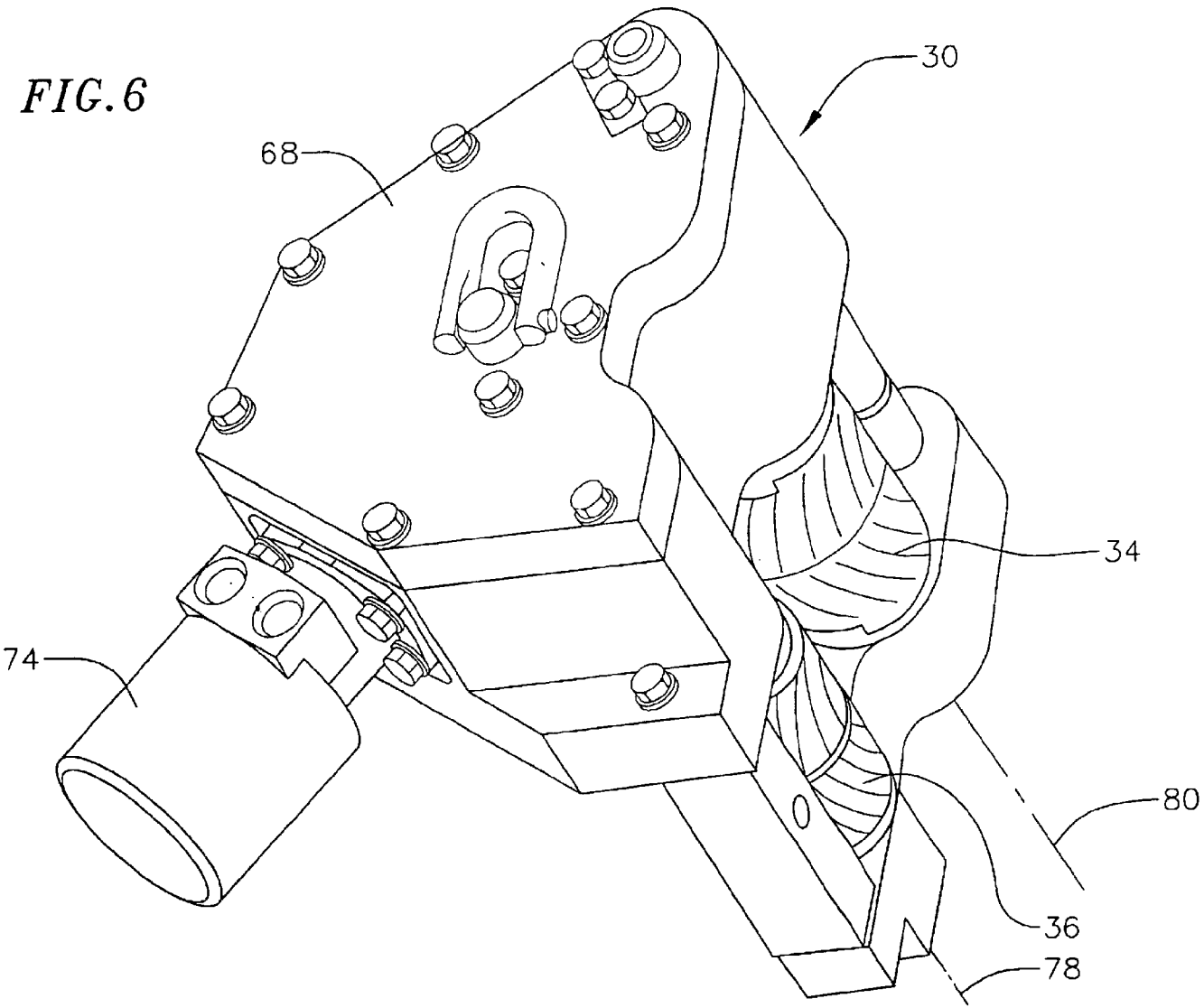
FIG. 6 is a perspective view of the left hand roller drive assembly of the iron roughneck of FIG. 1.
Figure 8:
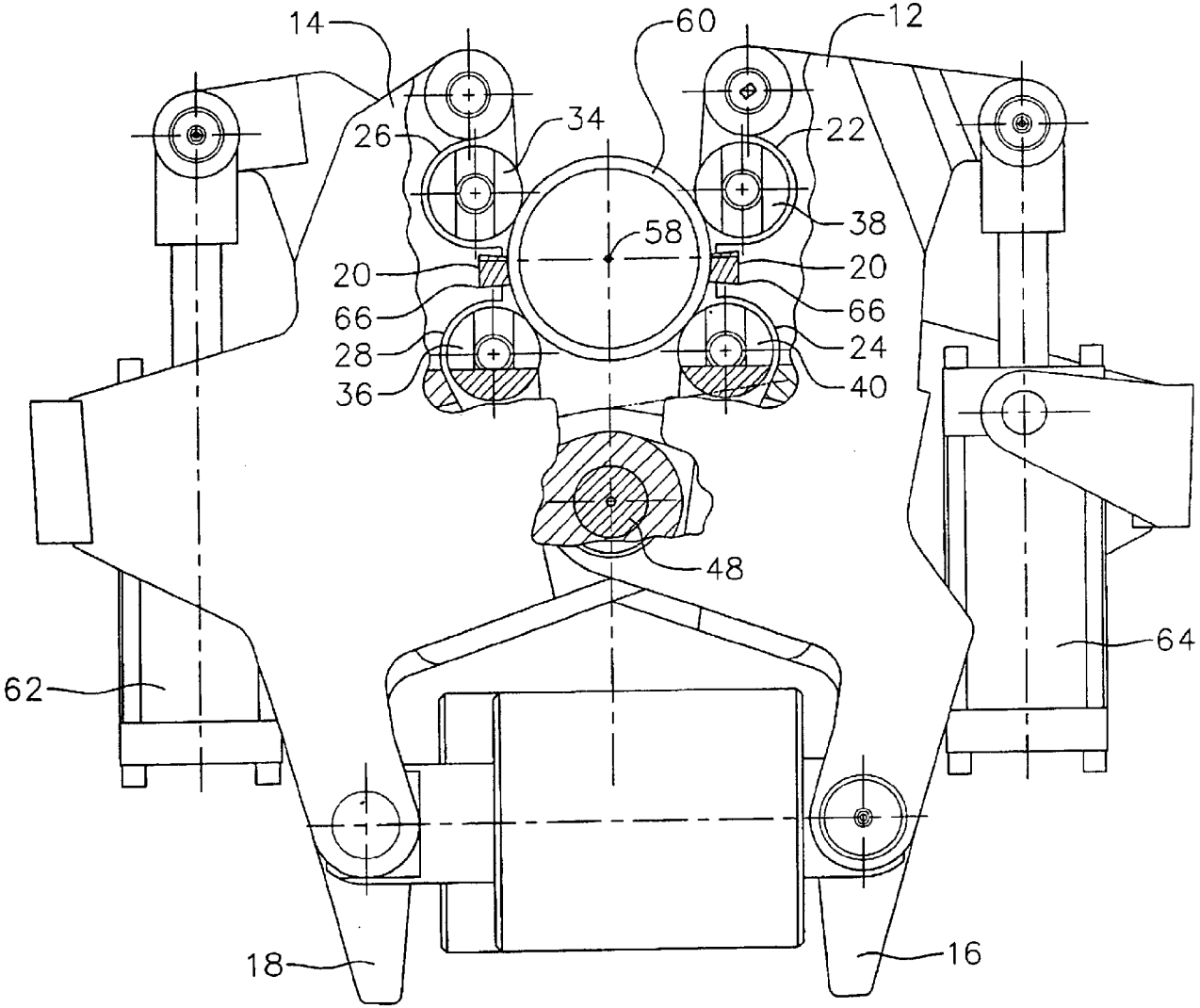
FIG. 8 is a top cross-sectional view of the iron roughneck taken along the line 8—8 of FIG. 3 and showing the spinning rollers and pipe gripping dies in the upper jaws.

As illustrated in FIGS. 5 and 8, the upper right jaw 12 has a front recess 22 and a rear recess 24 machined or formed therein. The upper left jaw 14 similarly has a front recess 26 and a rear recess 28. FIG. 6 shows a left spinner assembly 3( ) with a left front spinning roller 34 and a left rear spinning roller 36. A right spinner assembly 32 is the mirror image of left spinner assembly 30 and has a right front spinning roller 38 and a right rear spinning roller 40 (FIGS. 2 and 8). As illustrated in FIGS. 2 and 8, the left spinner assembly 30 is mounted above the upper left jaw 14 and the right spinner assembly 32 is mounted above the upper fight jaw 12 so that the spinning rollers 34, 36, 38 and 40 are positioned in the recesses 22, 24, 26 and 28, respectively. One of the pipe gripping dies is positioned between the spinning rollers 34 and 36, and the other pipe gripping die 20 is positioned between the spinning rollers 38 and 40. By positioning the spinning rollers 34, 36, 38 and 40 in the upper jaws 12 and 14 at the same level as the pipe gripping dies 20, the spinning rollers 34, 36, 38 and 40 are able to spin closer to the lower jaws 16 and 18, and thus engage the tool joint rather than the pipe stem.

FIG. 1 illustrates the iron roughneck 10 mounted on a support 42 for positioning relative to the drilling components to be connected or disconnected. Support 42 runs on tracks 44 to allow horizontal motion. The iron roughneck 10 is also mounted to a carriage 46 for vertical movement along the support 42. Vertical movement of the carriage is accomplished with a lift cylinder and two chains. Attached to the chains are springs that compensate for the vertical motion caused by the pipe threads moving relative to each other when connecting or disconnecting the pipes.

Figure 3:
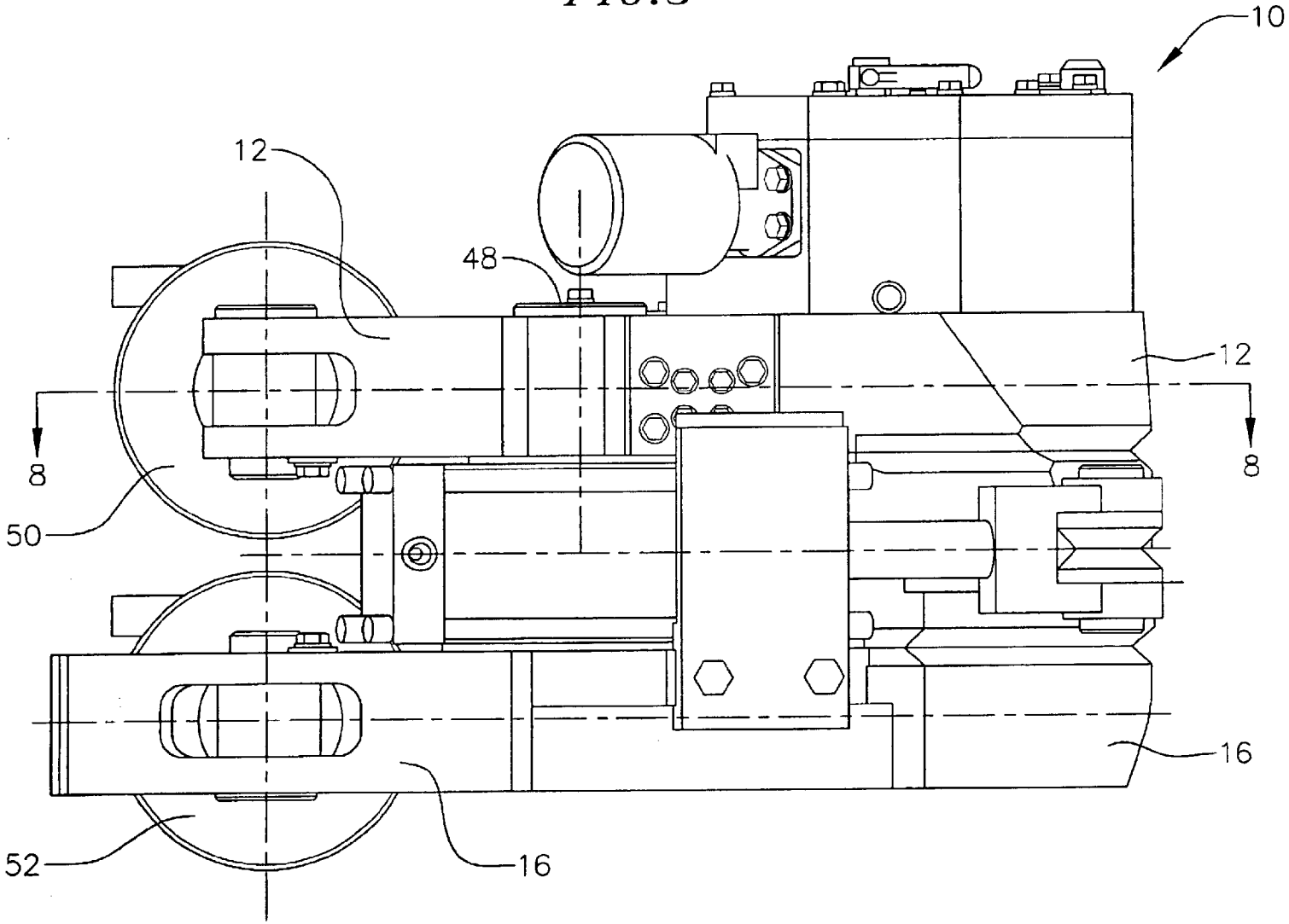
FIG. 3 is a right side elevated view of the iron roughneck of FIG. 1.
Figure 4:
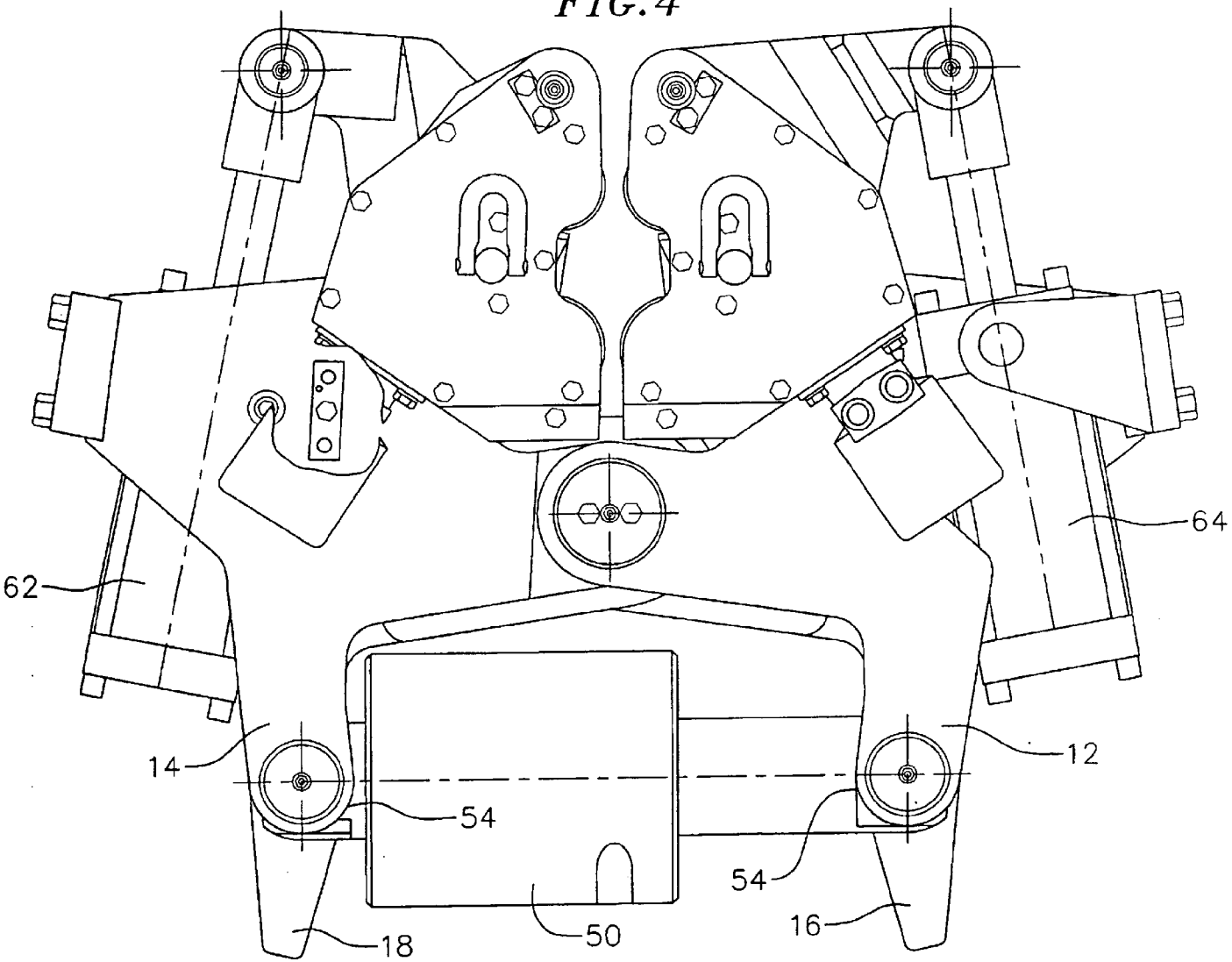
FIG. 4 is a top plan view of the iron roughneck of FIG. 1.

The jaws 12, 14, 16 and 18 work in a manner similar to those of a conventional torque wrench. As seen in FIG. 8, the upper jaws 12 and 14 are connected pivotally together by a vertical hinge pin 48 for motion of the upper jaws 12 and 14 toward and away from each other for gripping or releasing drilling components. FIG. 4 shows the upper jaws 12 and 14 in a relatively closed position, while FIG. 8 shows the upper jaws 12 and 14 in a relatively open position in which they grip a joint of drill pipe 60. The lower jaws 16 and 18 are essentially the same as the upper jaws 12 and 14, as discussed above, and are interconnected by the same hinge pin 48 as the upper jaws for pivotal actuation between gripping and released conditions. FIGS. 2 and 3 illustrate an upper jaw gripping piston and cylinder mechanism 50 received between inner ends of the upper jaws 54 for actuating the upper jaws between their gripping and released conditions. The figures further illustrate a lower jaw gripping piston and cylinder mechanism 52 received between inner ends of lower jaws 56 for actuating the lower jaws between their gripping and released conditions. In their open conditions, the jaws are far enough apart to allow the torque wrench to move between a position about the pipe and a position laterally offset therefrom. The upper jaw gripping piston and cylinder mechanism 50 and the lower jaw gripping piston and cylinder mechanism 52 work independently of each other to open and close the upper and lower jaws.

After the jaws have been positioned at a connection between two sections of pipe, the lower jaws 16 and 18 grip the upper tool joint of the lower pipe section and the upper jaws 12 and 14 grip the lower tool joint of the upper pipe section. The upper jaws 12 and 14 and the lower jaws 16 and 18 can then be turned relative to one another about the vertical axis 58 of the pipes 60 shown in FIG. 8 to either break-out or make-up a threaded connection between the pipes. To attain this relative rotation, a left torquing piston and cylinder mechanism 62 has its cylinder connected to the upper left jaw 14 and its piston connected to the lower left jaw 18 as shown in FIGS. 4 and 8. Also shown in FIGS. 4 and 8, a right torquing piston and cylinder mechanism 64 has its cylinder connected to the lower right jaw 16 and its piston connected to the upper right jaw 12. Thus, the torquing piston and cylinder mechanisms 62 and 64 can power rotate the upper and lower jaws in either direction relative to one another and about the axis 58 of the gripped pipe 60.

As illustrated in FIG. 8, each of the upper jaws 12 and 14 has a single pipe gripping die 20. In the iron roughneck 10 of the present invention, the spinning rollers 34, 36, 38 and 40 are positioned in the upper jaws along with the gripping dies such that each gripping die 20 is disposed between a pair of spinning rollers. Due to this arrangement, there is very little space for mounting the pipe gripping dies 20. Thus, several special features are utilized to support the pipe gripping dies 20.

Figure 9A:
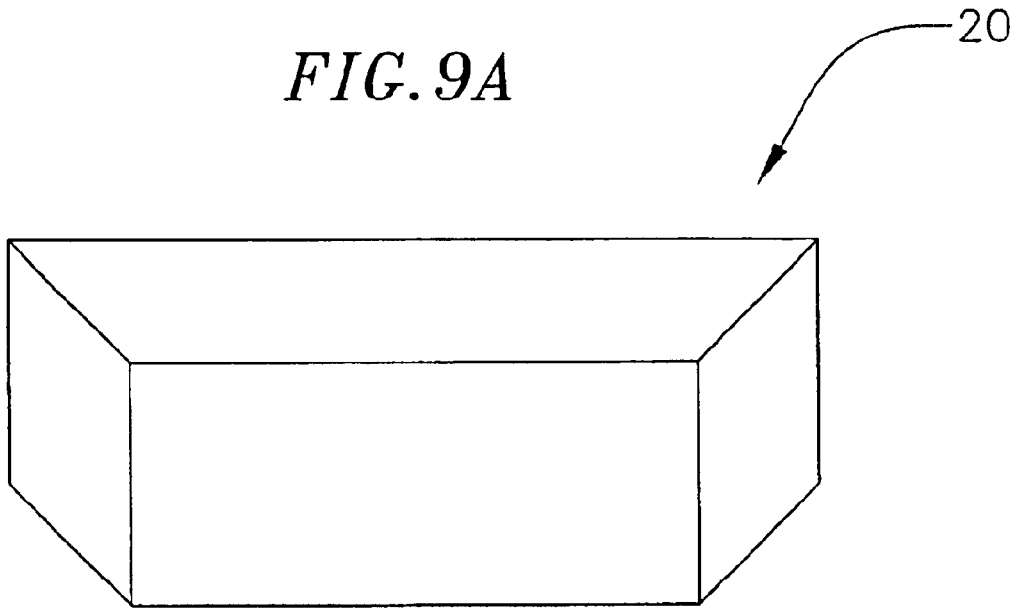
FIG. 9A is a front perspective view of a pipe gripping die and FIG. 9B is a rear elevational view of the same pipe gripping die showing its knurled backing.

The pipe gripping dies 20 are fan-shaped or dovetail-shaped (FIG. 9A) to fit into corresponding dovetail-shaped mortises or slots 66 formed in the upper jaws between the recesses 22, 24, 26 and 28. Each mortise 66 fans out in the direction going into the body of its respective upper jaw. Each dovetail-shaped gripping die 20 is inserted into its corresponding mortise 66 to form a dovetail connection. The narrow ends of the dovetail-shaped pipe gripping dies extend away from the upper jaw bodies in order to dig into and grip the tool joints. In one embodiment the dies are removable from the mortises 66 so that as the mortises 66 wear out they can be replaced.

Figure 9B:
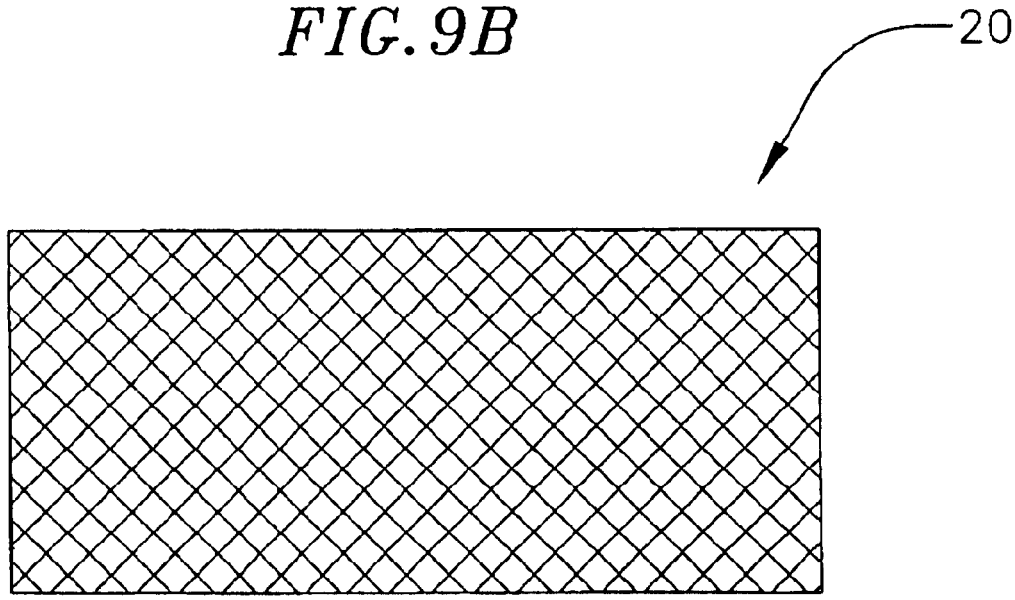

As shown in FIG. 9B, the torque gripping dies 20 of the illustrated embodiment have knurled backings in order to better secure the gripping dies 20 against the back of the corresponding mortises 66, thus transferring torque load from the sides of the mortises 66 to the back of the mortises. The knurled surface may be formed of a series of v-shaped grooves resulting in a plurality of pointed, pyramid-shaped projections. This protects the sides of the mortises 66 which are relatively thin pieces due to the proximity of the recesses 22, 24, 26 and 28 and which therefore should not be subjected to high loads.

The lower jaws 16 and 18 can utilize the die arrangement described above or else can utilize other arrangements.

Figure 7:
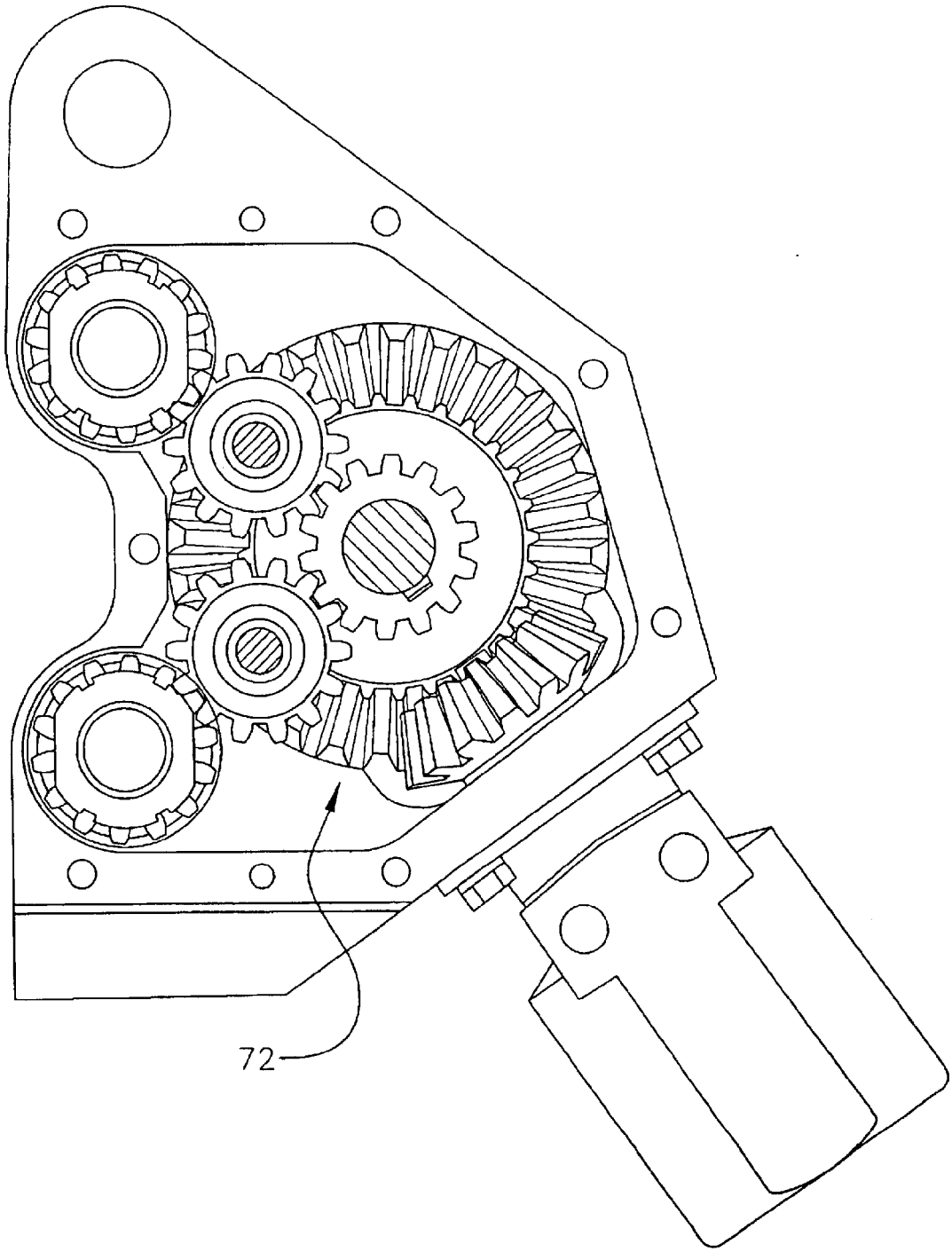
FIG. 7 is a top plan view of the right hand roller drive assembly with the top cover removed to show the gear train.

FIG. 6 illustrates the left spinner assembly 30 with a front spinning roller 34 and a rear spinning roller 36. The right spinner assembly 32 is the mirror image of the left spinner assembly 30 and is therefore not shown separately in detail. The description below also applies to the right spinner assembly 32. The spinner assembly 30 is mounted above the upper jaw 12 so that the spinning rollers 34 and 36 extend into the recesses 26 and 28. A hydraulic spinning motor 74 is mounted at the side of housing 68. As illustrated in FIG. 7, inside the spinner assembly housing 68 is a gear train 72 for transferring power from the motor 74 to the spinning rollers 34 and 36. Other motors and spinner assemblies can also be used for this purpose, as long as they are capable of rotating the rollers 34 and 36 and are sufficiently compact.

It is desirable to locate the motor 74 on the side of spinner assembly housing 68 as shown in FIG. 2, rather than above it in order to clear structures located above the iron roughneck 10. The beveled gears of the gear train 72 allow transfer of rotational motion from the horizontal axis 76 of the motor 74 to the vertical axes 78 and 80 of the rollers 34 and 36. The gear train 72 also serves to divide power equally from the single motor 74 to the two rollers 34 and 36.

Traditionally, spinning rollers have had smooth surfaces because they turn on the smooth surface of the pipe stem. However, in the present invention the spinning rollers 34 and 36 advantageously turn on the rough surface of the tool joint.

The surfaces of the tool joints can become rough due to the pipe gripping dies 20 digging in to hold the pipe securely. Smooth surfaced spinning rollers can be damaged by the pits and projections on the tool joint and can be forced away from the surface of the joint, thereby: stressing the mechanism of the spinning wrench. As shown in FIG. 6, the surfaces of the rollers 34 and 36 are provided with a knurled herring bone cross hatch pattern to better conform to the irregularities on the tool joint surfaces. The herring bone pattern provides ample open space on the roller surface for burrs and other blemishes to be received, and the ridges of the pattern sufficiently localize the forces to penetrate any burrs. Other patterns can also be provided on the roller surfaces to allow the rollers to conform to the irregularities on the tool joint surfaces.

When using the iron roughneck 10 to disconnect a threaded connection between a pin tool joint of an upper drill pipe section and a box tool joint of a lower pipe section, the lower pipe section is first set in the slips. The jaw gripping piston and cylinder mechanisms 50 and 52 are then activated to open the jaws 12, 14, 16 and 18. The iron roughneck 10 and the support 42 are then moved so that the box tool joint is between the lower jaws 16 and 18 and the pin tool joint is between the upper jaws 12 and 14. The jaw gripping piston and cylinder mechanisms 50 and 52 are again activated to grip the lower jaws 16 and 18 onto the box tool joint and grip the upper jaws 12 and 14 onto the pin tool joint. The force provided by the jaw gripping piston and cylinder mechanisms 50 and 52 engages the pipe gripping dies 20 against the tool joints for better gripping. Next, the torquing cylinder mechanisms 62 and 64 are activated to rotate the upper jaw counterclockwise relative to the stationary lower jaw (the lower jaw is gripped onto the lower joint of drill pipe which is set in the slips) to break the connection between the pin and box tool joints. The jaw gripping piston and cylinder mechanism 50 is then activated to release the upper jaws 12 and 14 and the spinning rollers 34, 36, 38 and 40 are brought into contact with the pin box tool joint. The left side hydraulic spinning motor 74 and a right side hydraulic spinning motor 82 are then activated to spin the pin tool joint counterclockwise relative to the box tool joint until the upper joint of drill pipe is disconnected from the lower joint of drill pipe.

In order to use the iron roughneck 10 to connect a threaded connection between a pin tool joint of an upper joint of drill pipe and a box tool joint of a lower joint of drill pipe, the above procedure is reversed.

In addition to the hydraulic motors specified above, any other powerful, compact motors can be used. Also, the spinner assemblies 30 and 32 can be located at other positions above, inside, beside or below the jaws. The rollers can be disposed in the lower jaws rather than the upper jaws in order to spin out components from below. Rollers can also be disposed in both the upper and lower jaws to provide further options. Greater numbers of dies or rollers can also be used with the present invention.

While the above description contains many specific features of the invention, these should not be construed as limitations on the scope of the invention, but rather as one exemplary embodiment thereof. Many other variations are possible. Accordingly, the scope of the invention should be determined not by the embodiments illustrated, but by the appended claims and their legal equivalents.

What is claimed is:

1. Apparatus for connecting and disconnecting threaded well drilling components, comprising:

a first set of jaws at a first level with a first set of gripping die portions disposed therein for gripping a first well drilling component, said first set of jaws forming recesses;

a second set of jaws at a second level with a second set of gripping die portions disposed therein for gripping a second well drilling component;

said first and second sets of jaws providing torque to tighten or loosen a threaded connection between said first and second well drilling components;

a plurality of spinning rollers received within said recesses at said first level and operable to connect and disconnect said first and second well drilling components.

2. The apparatus of claim 1, wherein: roller surfaces of said spinning rollers are textured.

3. The apparatus of claim 1, wherein: roller surfaces of said spinning rollers are knurled.

4. The apparatus of claim 3, wherein: said roller surfaces are knurled in a cross hatch pattern.

5. The apparatus of claim 1, wherein:

said gripping die portions are dovetail-shaped die portions engaged in dovetail-shaped slots formed in the walls of said first and second sets of jaws.

6. The apparatus of claim 5, wherein:

one side of each dovetail-shaped die portion is disposed to engage said first well drilling component and an opposite side of each dovetail-shaped die portion has a knurled backing disposed to engage a surface of each of said dovetail-shaped slots.

7. The apparatus of claim 5, wherein:

said first set of jaws has a first jaw and a second jaw;

each of said first and second jaws has a pair of recesses therein;

one of said spinning rollers is positioned in each of said recesses; and one of said dovetail-shaped die portions is disposed between each of said pairs of recesses.

8. The apparatus of claim 1, further comprising:

at least one gear drive having a pair of beveled gears coupled to a motor to drive said spinning rollers.

9. The apparatus of claim 8, wherein:

each of said gear drives is positioned at a third level adjacent to said first level.

10. The apparatus of claim 9, wherein:

each of said motors extends laterally from said spinner assembly.

11. The apparatus of claim 1 wherein:

said first set of jaws comprises a first jaw and a second jaw;

said first jaw defines first and second recesses having spinning rollers disposed therein;

said second jaw defines first and second recesses having spinning rollers disposed therein;

a first motor drives the spinning rollers of said first jaw through a first spinner assembly utilizing beveled gears;

a second motor drives the spinning rollers of said second jaw through a second spinner assembly utilizing beveled gears.

12. The apparatus of claim 11, wherein:

said first and second motors extend laterally from said spinner assemblies.

13. The apparatus of claim 1, wherein:

said first and second sets of jaws are operable to independently engage and disengage said first and second well drilling components, respectively.

14. A method for connecting and disconnecting threaded well drilling components, comprising the steps of:

gripping a first tool joint of a first well drilling component with a first set of jaws at a first level while gripping a second tool joint of a second well drilling component with a second set of jaws at a second level;

turning said first and second sets of jaws relative to each other to apply torque to tighten or loosen a threaded connection between said first and second well drilling components;

disengaging said first set of gripping die portions from the first tool joint and engaging a set of rollers with said first tool joint at said first level; and spinning said rollers to connect or disconnect said first and second well drilling components.

* * * * *